US006880184B2

(12) United States Patent
Vandersand

(10) Patent No.: US 6,880,184 B2
(45) Date of Patent: Apr. 19, 2005

(54) URINAL COVER

(76) Inventor: Daniel J. Vandersand, R.R. #1, Box 166, White Hall, IL (US) 62092

( * ) Notice: Subject to any disclaimer, the term of this patent is extended or adjusted under 35 U.S.C. 154(b) by 151 days.

(21) Appl. No.: 10/345,741

(22) Filed: Jan. 16, 2003

(65) Prior Publication Data

US 2004/0139535 A1 Jul. 22, 2004

(51) Int. Cl.[7] ..... A47K 1/00; E03D 13/00
(52) U.S. Cl. ..... 4/661; 4/310
(58) Field of Search ..... 4/301, 310, 457, 4/245.5, 661; 150/156, 165

(56) References Cited

U.S. PATENT DOCUMENTS 3,116,774 A * 1/1964 Callahan ..... 220/200
5,590,426 A * 1/1997 Moffre et al. ..... 4/301

* cited by examiner

*Primary Examiner*—Charles E. Phillips
(74) *Attorney, Agent, or Firm*—Polster, Lieder, Woodruff & Lucchesi, L.C.

(57) ABSTRACT

A urinal cover including a flexible sheet of material having a periphery, a water supply attachment patch attached to the sheet adapted to be place around a water supply pipe of a urinal, and an elastic strip sewn into a portion of the periphery of the sheet.

6 Claims, 2 Drawing Sheets

URINAL COVER

BACKGROUND OF THE INVENTION

1. Field of the Invention

The field of the invention relates generally to urinal covers. More specifically, the field of the invention relates to a disposable, compact urinal cover.

2. Description of Related Art

In practice, urinal covers are not widely used for taking malfunctioning urinals out of service. This is primarily due to the fact that prior art urinal covers are large, bulky and require reuse. Because it is desirable to limit the amount of space dedicated to storing janitorial supplies, large preformed urinal covers are undesirable. Additionally, because prior art urinal covers were made from hard plastic, they were not disposable. Rather they had to be cleaned in order to maintain sanitary conditions. Finally, because urinals have many different profiles hard plastic urinal covers either do not fit every type of urinal properly or specific urinal covers with certain shapes must be ordered by an end user.

For these reasons, urinal covers have not gained widespread acceptance despite the fact that urinal frequently become clogged and must be taken out of service.

DESCRIPTION OF THE PREFERRED EMBODIMENT

Figure 1:
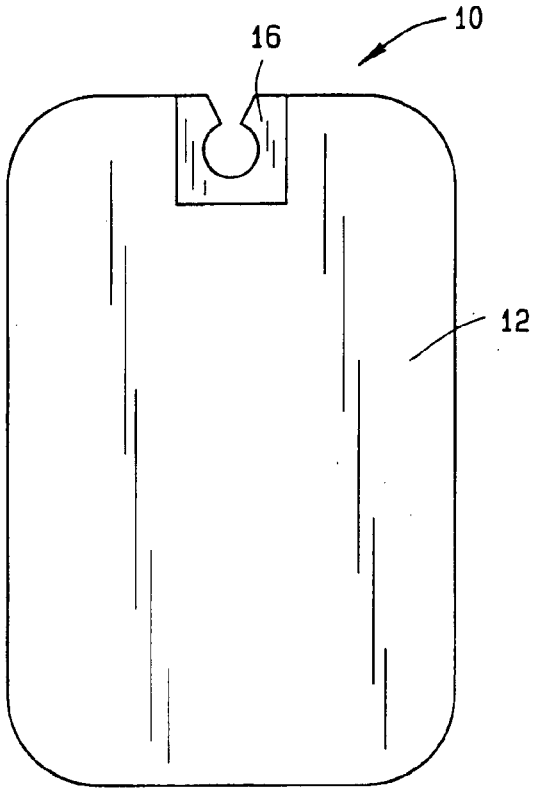
FIG. 1 is a view of a urinal cover before elastic has been sewn into the seams according to the present invention.

While the invention is susceptible of embodiment in many different forms, there is shown in the drawings and described in detail preferred embodiments of the invention. It is to be understood that the present disclosure is to be considered only as an example of the principles of the invention. This disclosure is not intended to limit the broad aspect of the invention to the illustrated embodiments. The scope of protection should only be limited by the claims.

Figure 2:
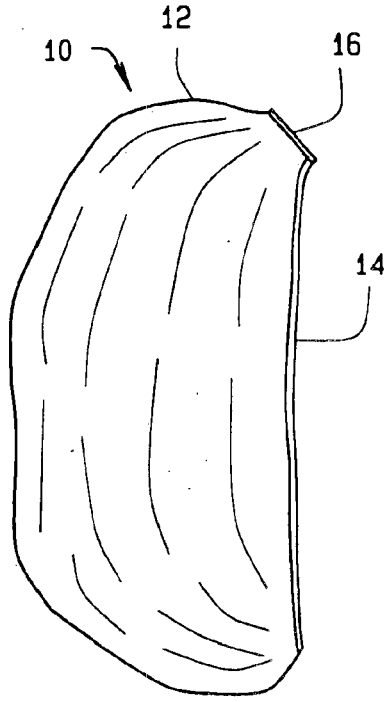
FIG. 2 is a view of a urinal cover after elastic has been sewn into the seams according to the present invention.

Referring to FIGS. 1 and 2, the present invention provides a urinal cover 10 made from a flat, generally rectangular sheet 12 of plastic having the corners rounded. The edges of the sheet of plastic are folded back upon the sheet 12 and a length of elastic 14 is sewn into the edge of the sheet 12. Glued to the sheet 12 is a water supply attachment patch 16. The water supply attachment patch 16 is preferable made from a resilient plastic or rubber material. Preferably, the water supply attachment patch 16 generally comprises a rectangular portion having a circular cutout 22 therein. Additionally, a V-shaped cutout 24 extends from a side of the patch 16 to the circular cutout 22. Because the cover 10 is made primarily of plastic and elastic, the cover 10 can be collapsed to take very little space when not in use and can be used disposably in order to avoid every having to clean the cover.

Figure 3:
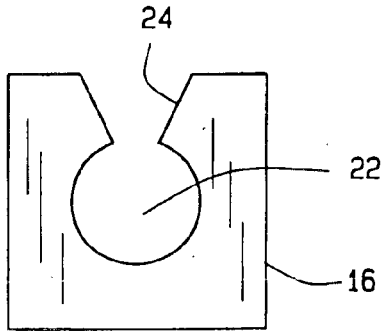
FIG. 3 is a water supply attachment patch according to the present invention.
Figure 4:
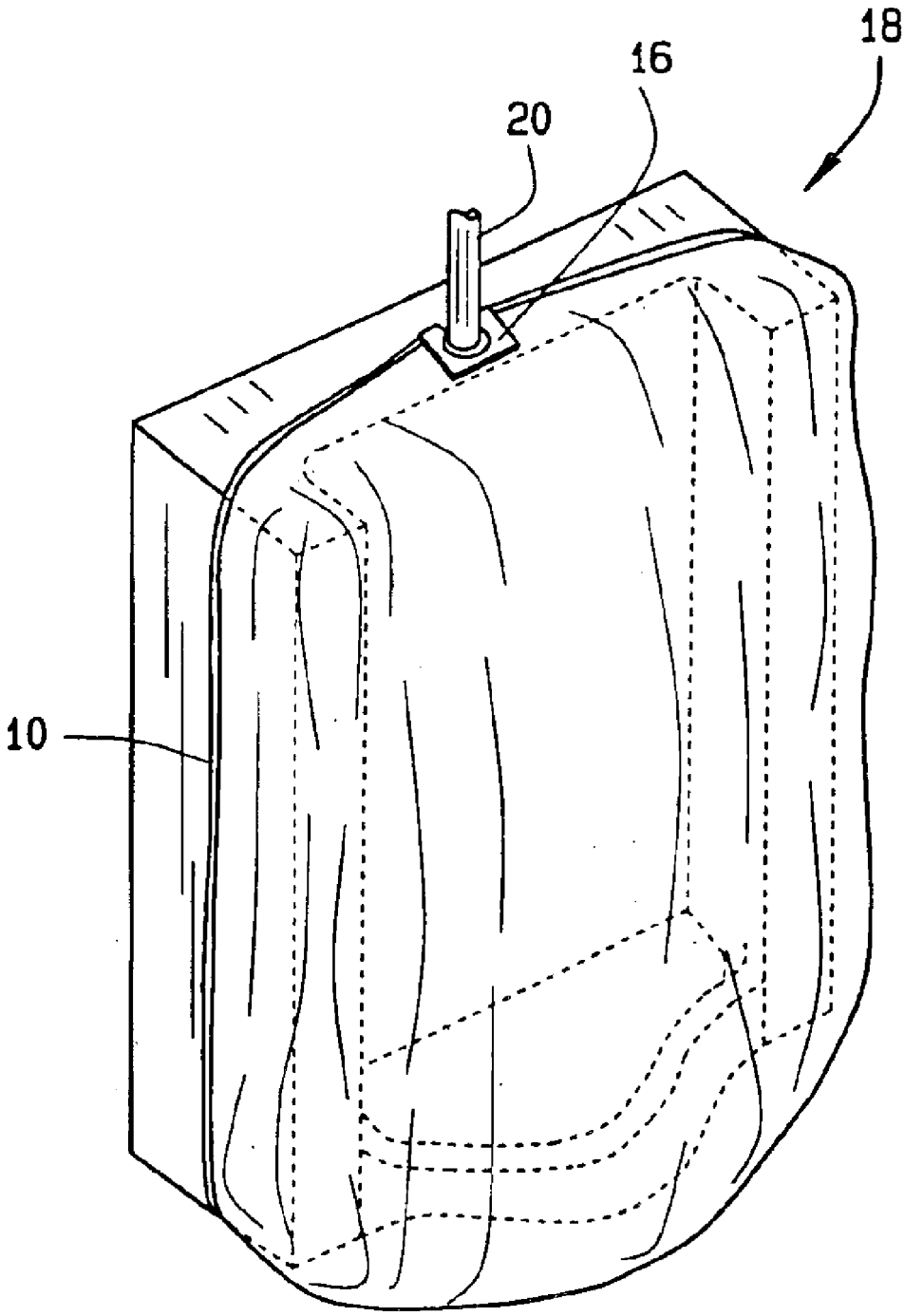
FIG. 4 is urinal cover placed on a urinal according to the present invention.

Referring to FIG. 3, conventional urinals 18 have a water supply pipe 20 coming from the top of the urinal 18. The bag is used to cover the urinal by attaching the water supply attachment patch 16 to the water supply pipe 20. Because the water supply attachment patch 16 is made from resilient material is resiliently deforms as it is pushed around the pipe 20 and retains itself upon the pipe 20 after installation. Next, the elastic 14 is stretched and placed around the outer periphery of the urinal 18. The elastic 14 contacts the outer periphery of the urinal 18 and holds the cover 10 to the urinal 18.

While the specific embodiments have been illustrated and described, numerous modifications come to mind without significantly departing from the spirit of the invention, and the scope of protection is only limited by the scope of the accompanying claims.

I claim:

1. A urinal cover comprising:

a flexible sheet of material having a periphery;

a water supply attachment patch attached to the sheet adapted to be placed around a water supply pipe of a urinal; where it deforms and retains itself upon the pipe an elastic strip attached to a portion of the periphery of the sheet; and wherein the flexible sheet defines an opening in the periphery over which said attachment patch is secured.

2. The urinal cover of claim 1 wherein the sheet is generally rectangular and the corners of the generally rectangular sheet have been rounded.

3. A urinal cover comprising:

a flexible sheet of material having a periphery;

a water supply attachment patch attached to the sheet adapted to be place around a water supply pipe of a urinal at a location adjacent to the periphery of the sheet;

an elastic strip sewn into a portion of the periphery of the sheet; and wherein the water supply attachment patch defines a circular cutout and a V-shaped cutout to allow attachment to the water supply pipe of the urinal.

4. A method of covering a urinal comprising:

providing a flexible sheet of material having a periphery and an opening at a point along the periphery;

providing a water supply attachment patch attached to the sheet over the opening;

providing an elastic strip attached to a portion of the periphery;

attaching the water supply attachment patch to a water supply pipe of the urinal such that the water supply pipe extends through the opening of the sheet; and expanding the elastic strip about the periphery of the urinal.

5. The method of claim 4 wherein the sheet is generally rectangular and the corners of the generally rectangular sheet have been rounded.

6. The method of claim 4 wherein the water supply attachment patch defines a circular cutout and a V-shaped cutout to allow attachment to the water supply pipe of the urinal.

* * * * *